US009534754B2

(12) United States Patent
Kim

(10) Patent No.: US 9,534,754 B2
(45) Date of Patent: Jan. 3, 2017

(54) EASILY EXPANDABLE INDOORS LED LIGHTING DEVICE

(71) Applicant: KMW INC., Hwaseong, Gyeonggi-Do (KR)

(72) Inventor: Duk Yong Kim, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 256 days.

(21) Appl. No.: 14/512,247

(22) Filed: Oct. 10, 2014

(65) Prior Publication Data

US 2015/0029705 A1 Jan. 29, 2015

Related U.S. Application Data

(63) Continuation of application No. PCT/KR2013/002973, filed on Apr. 9, 2013.

(30) Foreign Application Priority Data

Apr. 10, 2012 (KR) ..... 20-2012-0002931 U

(51) Int. Cl.

| | |
|---|---|
| ***F21S 8/00*** | (2006.01) |
| ***F21S 8/04*** | (2006.01) |
| ***F21V 17/00*** | (2006.01) |
| ***F21V 7/00*** | (2006.01) |
| ***F21V 7/09*** | (2006.01) |
| ***F21S 2/00*** | (2016.01) |

(Continued)

(52) U.S. Cl.

CPC ..... *F21S 8/043* (2013.01); *F21S 2/005* (2013.01); *F21S 8/04* (2013.01); *F21V 7/0066* (2013.01); *F21V 7/09* (2013.01); *F21V 17/00* (2013.01); *F21V 23/06* (2013.01); *F21V 7/00* (2013.01); *F21V 21/005* (2013.01); *F21Y 2101/00* (2013.01); *F21Y 2101/02* (2013.01)

(58) Field of Classification Search

CPC ..... F21S 8/043; F21V 7/09; F21Y 2101/02
USPC ..... 362/147, 148, 341
See application file for complete search history.

(56) References Cited

U.S. PATENT DOCUMENTS

| | | | |
|---|---|---|---|
| 2003/0063463 | A1 | 4/2003 | Sloan et al. |
| 2009/0086478 | A1 | 4/2009 | Sanroma et al. |

(Continued)

FOREIGN PATENT DOCUMENTS

| | | | |
|---|---|---|---|
| DE | 202010013142 | U1 | 2/2011 |
| JP | 2010-118277 | A | 5/2010 |

(Continued)

*Primary Examiner* — Ali Alavi

(74) *Attorney, Agent, or Firm* — Mintz Levin Cohn Ferris Glovsky and Popeo, P.C.; Kongsik Kim; Colleen H. Witherell

(57) ABSTRACT

The present invention relates to an easily expandable indoors LED lighting device, comprising: a fixing bar which is installed on a ceiling; first and second electrode bars, which are provided on a rear surface of the fixing bar; a socket which is provided at the center of the fixing bar that is provided with the first and second electrode bars; and a bell-shaped reflective portion, which is coupled to the socket, for providing power from the first and second electrode bars to a substrate on the inside of which an LED is mounted. The present invention is lightweight, can be directly installed on the ceiling by coupling, and enables expanded installation of the lighting device that is modularized in accordance with the surface area of the ceiling, thereby providing the advantage of easy installation.

7 Claims, 6 Drawing Sheets

(51) Int. Cl.

| | |
|---|---|
| ***F21V 23/06*** | (2006.01) |
| *F21V 21/005* | (2006.01) |
| *F21Y 101/02* | (2006.01) |
| *F21Y 101/00* | (2016.01) |

(56) References Cited

U.S. PATENT DOCUMENTS

| | | | |
|---|---|---|---|
| 2010/0110701 | A1 | 5/2010 | Liu et al. |
| 2011/0273892 | A1 | 11/2011 | Mostoller et al. |

FOREIGN PATENT DOCUMENTS

| | | | |
|---|---|---|---|
| KR | 10-2011-0002620 | A | 1/2011 |
| KR | 10-2011-0107134 | A | 9/2011 |
| KR | 10-2011-0132059 | A | 12/2011 |
| KR | 10-2012-0029896 | A | 3/2012 |
| WO | WO-2007/069130 | A2 | 6/2007 |
| WO | WO-2008/137618 | A1 | 11/2008 |

EASILY EXPANDABLE INDOORS LED LIGHTING DEVICE

CROSS-REFERENCE TO RELATED APPLICATIONS

This application is a continuation of International Application No. PCT/KR2013/002973 filed on Apr. 9, 2013, which claims priority to Korean Application No. 20-2012-0002931 filed on Apr. 10, 2012. The applications are incorporated herein by reference.

TECHNICAL FIELD

The present invention relates to an indoor LED lighting device, and more particularly to an indoor LED lighting device which can be easily expanded according to an area of an indoor ceiling.

BACKGROUND ART

In general, a plurality of fluorescent lights are installed on a ceiling of an interior such as an office to light the interior. Fluorescent lights as light sources are relatively inexpensive but have a relatively short life span, and the brightness of the fluorescent lights decreases over time.

A radiation angle corresponding to an angle by which light is emitted is 120 degrees or more, and an interior space is illuminated at intensities of illumination which are similar as a whole.

In order to solve a problem of a fluorescent light as a light source, which has a relatively short life span and a brightness of which gradually decreases over time, technologies for employing LEDs having a very long life span and consuming low electric power have been developed.

As an example, lamps employing LEDs as light sources as in Korean Patent 10-1052457 illuminate an interior after the radiation angle of light emitted from the LEDs thereof is widened to 120 degrees or more by employing a diffusion plate or a lens.

However, in the space lighting method according to the related art, an energy saving effect cannot be obtained while LEDs of a high efficiency are used. Accordingly, an LED surface light emitting device for replacing an existing fluorescent light is adapted to illuminate an entire interior space, and does not consider a relationship between an intensity of horizontal illumination and an intensity of vertical illumination.

When a diffusion plate or a lens is used, loss of light cannot be avoided, and accordingly, higher electric power cannot help being used for the same intensity of illumination.

Further, according to the related art, a reflection plate is provided on the rear side of a light source, a lighting device cannot be easily carried and installed because a weight thereof is relatively heavy due to a metal frame for fixing a substrate, and the lighting device cannot be easily installed and maintained because a safety accident should be prevented by firmly fixing the lighting device such that the light device does not fall when being installed on the ceiling.

In addition, according to the related art, the above-described indoor LED lighting devices employing a metal frame should be individually installed, and electric power should be supplied to each indoor LED light device. Accordingly, much time is consumed in the installation operation.

SUMMARY

Therefore, the present invention has been made in view of the above-mentioned problems, and an aspect of the present invention is to provide an easily expandable indoor LED lighting device which can provide a sufficient intensity of illumination for a practical space while consuming low electric power.

The present invention also provides an indoor LED lighting device which can be very easily installed due to a light weight thereof and can be expanded according to an area of an interior.

In accordance with an aspect of the present invention, there is provided an easily expandable indoor LED lighting device including: a fixing bar installed on a ceiling; first and second electrode bars provided on a bottom surface of the fixing bar; a socket provided at the center of the fixing bar provided with the first and second electrode bars; and a bell-shaped reflection unit coupled to the socket, for supplying electric power of the first and second electrode bars to a substrate to which an LED is mounted.

The easily expandable indoor LED lighting device according to the present invention can adjust a ratio of an intensity of horizontal illumination to an intensity of vertical illumination according to a purpose of an interior space, and reduce consumption of electric power by increasing light efficiency of the illumination.

In addition, the easily expandable indoor LED lighting device according to the present invention is light-weight, can be directly attached to a ceiling, and can be easily installed because a lighting device modulated according to an area of the ceiling can be extended.

DETAILED DESCRIPTION

Hereinafter, a configuration and an operation of an easily expandable indoor LED lighting device according to an exemplary embodiment of the present invention will be described with reference to the accompanying drawings.

Figure 1:
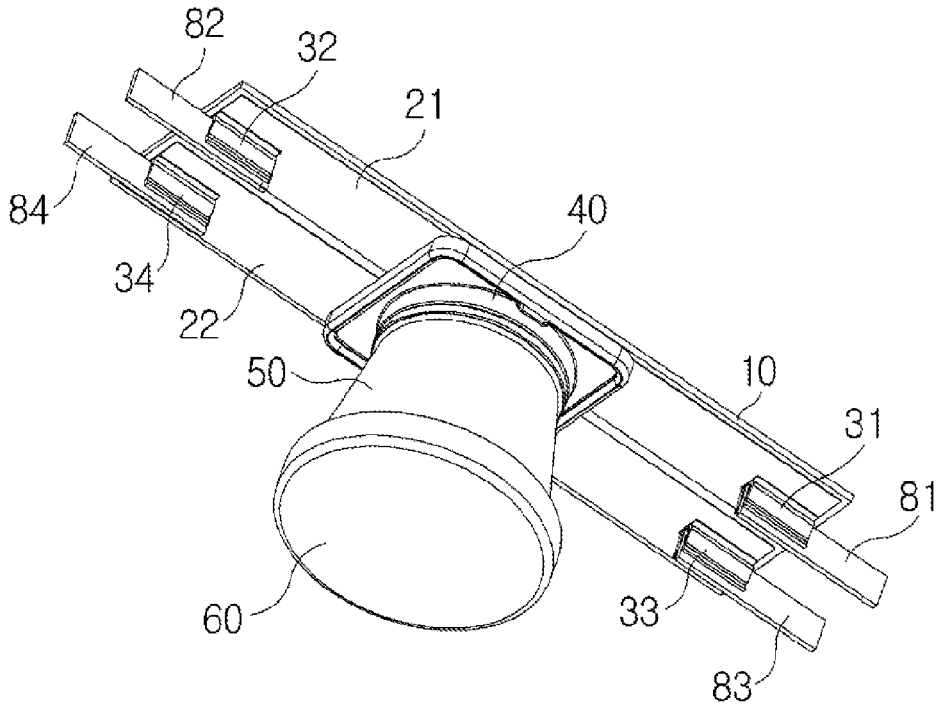
FIG. 1 is a perspective view of an easily expandable indoor LED lighting device according to an exemplary embodiment of the present invention.
Figure 2:
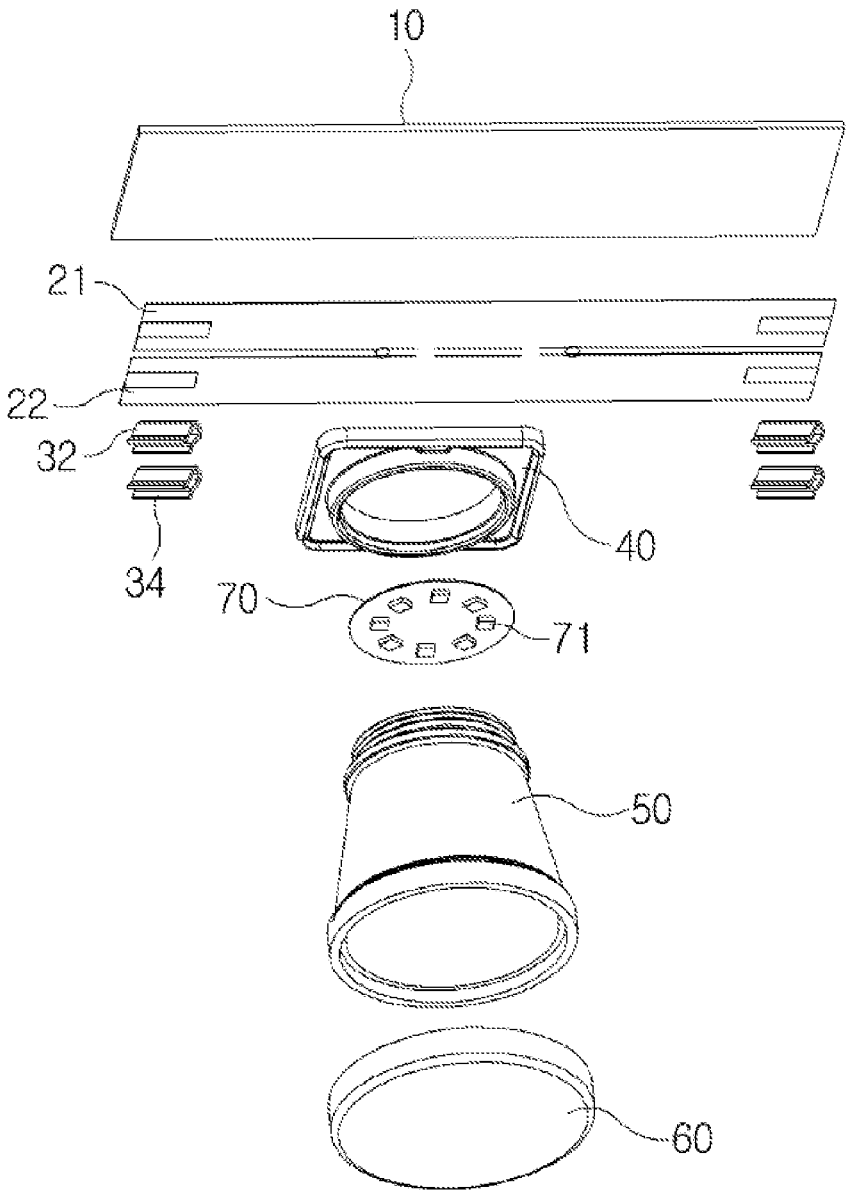
FIG. 2 is an exploded perspective view of FIG. 1.
Figure 3:
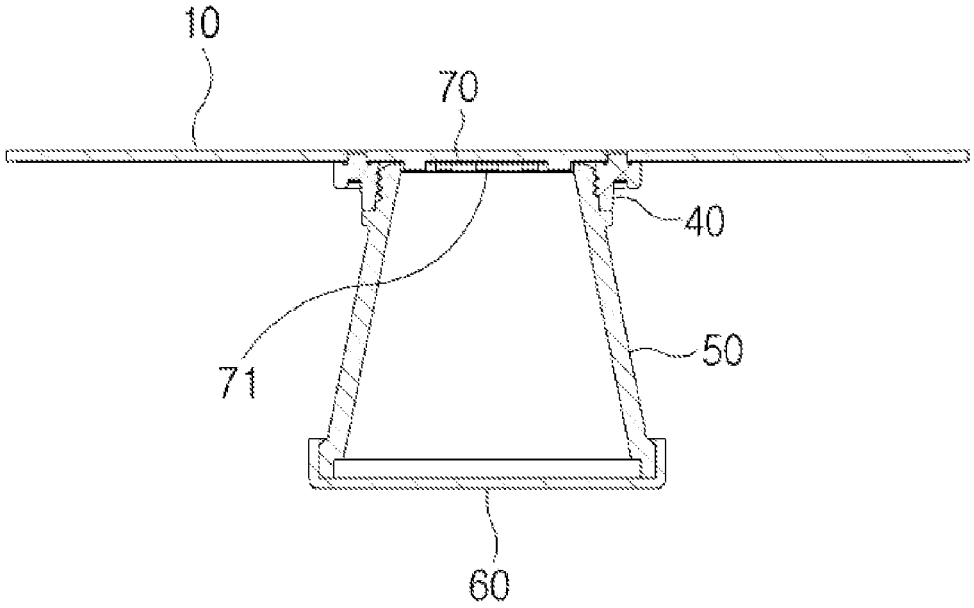
FIG. 3 is a sectional view of FIG. 1.

FIG. 1 is a perspective view of an easily expandable indoor LED lighting device according to an exemplary embodiment of the present invention. FIG. 2 is an exploded perspective view of FIG. 1. FIG. 3 is a sectional view of FIG. 1.

Referring to FIGS. 1 to 3, an easily expandable indoor LED lighting device according to an embodiment of the present invention includes a fixing bar 10 attached to a ceiling, a first electrode bar 21 and a second electrode bar 22 fixed to a bottom surface of the fixing bar 10 in parallel, a first slit connection unit 31 and a second slit connection unit 32 fixed to opposite ends of the first electrode bar 21 and into which a first connection bar 81 and a second connection bar 82 may be inserted, respectively, a third slit connection unit 33 and a fourth slit connection unit 34 fixed to opposite ends of the second electrode bar 22 and into which a third connection bar 83 and a fourth connection bar 84 may be inserted, a socket 40 provided at a central portion of a bottom surface of the fixing bar 10, a bell-shaped reflection unit 50 coupled to the socket, a substrate provided in an inside of the bell-shaped reflection unit 50, for receiving electric power through the first electrode bar 21 and the second electrode bar 22 and supplying the received electric power to a mounted LED 71, and a cover 60 coupled to a lower end of the bell-shaped reflection unit 50.

Hereinafter, a configuration and an operation of the easily expandable indoor LED lighting device according to the embodiment of the present invention will be described in more detail.

First, the fixing bar 10 is an insulator formed of a resin or the like, and is thin to minimize a weight thereof and has a long shape in one direction. The fixing bar 10 may be attached and fixed to the ceiling of an interior through a coupling means such as a bolt, a double-sided tape, or the like.

A first electrode bar 21 and a second electrode bar 22 are formed on the bottom surface of the fixing bar 10. The first electrode bar 21 and the second electrode bar 22 are thin conductors, and may be spaced apart from each other to act as a positive electrode and a negative electrode.

The first electrode bar 21 and the second electrode bar 22 may be separate thin metal plates which are attached to the fixing bar 10, and may be printed on the fixing bar 10 using a conductor paste.

The first electrode bar 21 and the second electrode bar 22 function to supply electric power to the substrate 70 to which an LED 71 is mounted, the first slit connection unit 31 and the second slit connection unit 32 are provided at opposite ends of the bottom surface of the first electrode bar 21 so that a plurality of unit bodies may be continuously coupled to each other while the structure of FIG. 1 is taken as one unit body such that electric power may be continuously supplied to the unit bodies and a third slit connection unit 33 and a fourth slit connection unit 34 are provided at opposite ends of the bottom surface of the second electrode bar 22.

Each of the first to fourth slit connection units 31 to 34 is shaped such that a slit is formed at the center thereof, and has a metallic resilient structure in which protrusion structures at opposite sides thereof converge toward the slit.

Next, a socket 40 is fixedly coupled to a central portion of the bottom surface of the fixing bar 10 provided with the first electrode bar 21 and the second electrode bar 22. The sockets 40 connects the first electrode bar 21 and the second electrode bar 22, which correspond to power supply units, to the substrate 70 and the bell-shaped reflection unit 50, which correspond to lighting units.

The bell-shaped reflection unit 50 is inserted into and fixed to the socket 40. The substrate 70 is fixed to an upper portion of an inside of the bell-shaped reflection unit 50 and the bell-shaped reflection unit 50 is coupled to the socket 40 such that electric power may be supplied through the first electrode bar 21 and the second electrode bar 22, so that the bell-shaped reflection unit 50 functions to limit a radiation angle to lower an intensity of vertical illumination and increase an intensity of horizontal illumination.

The limitation in radiation angle concentrates an entire intensity of radiation of a light source, which is the LED 71, so that an intensity of horizontal illumination may increase as the intensity of radiation is not dispersed toward a vertical surface but is concentrated toward a horizontal surface. An increase in the intensity of horizontal illumination may result in a sufficient intensity of illumination on a ceiling or a horizontal surface such as a surface of a desk, which is a target illumination area, and energy can be reduced using lower electric power by reducing the intensity of vertical illumination.

The bell-shaped reflection unit 50 may have a radiation angle ranging from 10 to 90 degrees such that a ratio of the intensity of vertical illumination to the intensity of horizontal illumination of an interior space is 2:8 to 4:6.

When the light radiation angle is less than 10 degrees, an illumination area is too small, and when the light radiation angle is 90 degrees or more, an effect of reducing the intensity of vertical illumination is lowered such that an energy reduction effect does not significantly appear.

When the intensity of vertical illumination is reduced by limiting the radiation angle while using the same illumination as the related art is used, the work space such as a desk becomes brighter due to an increase in the intensity of horizontal illumination but the vertically installed structures such as a wall surface or a partition of an interior appear dark. Accordingly, an entire intensity of illumination of the interior may become dark.

However, the intensity of horizontal illumination of a space where work is substantially performed becomes brighter than that of the related art, and an effect which is similar to an illumination of a stand installed in a work space while an interior illumination is switched off and a concentration with which the operator may work can be further improved.

In particular, because a monitor is perpendicular to a ceiling surface where a lighting device is generally installed, the intensity of vertical illumination of the lighting device has an effect while a person performs work while viewing the monitor. Accordingly, if the intensity of vertical illumination of the lighting device is lowered, the screen of the monitor may become clearer as the light of the lighting device input to and reflected from the monitor decreases. That is, the screen of the monitor may be made clearer by reducing the amount of light associated with the intensity of vertical illumination input to the screen of the vertically installed monitor The substrate 70 may be directly installed in the above-described socket 40, and the bell-shaped reflection unit 50 may be rotation-coupled or fitted with a peripheral portion of the socket 40. In addition, if the bell-shaped reflection unit 50 is fitted with the socket 40 in the state in which the substrate 70 is accommodated while an upper surface of the bell-shaped reflection unit 50 is blocked, the first and second electrode bars 21 and 22 directly contact each other to supply electric power.

The cover 60 is coupled to a lower side of the bell-shaped reflection unit 40. Then, the cover 60 is not a diffusion plate or a filter according to the related art but is a transparent plate, and functions to block dust or moisture from being introduced into the substrate 70.

Figure 4:
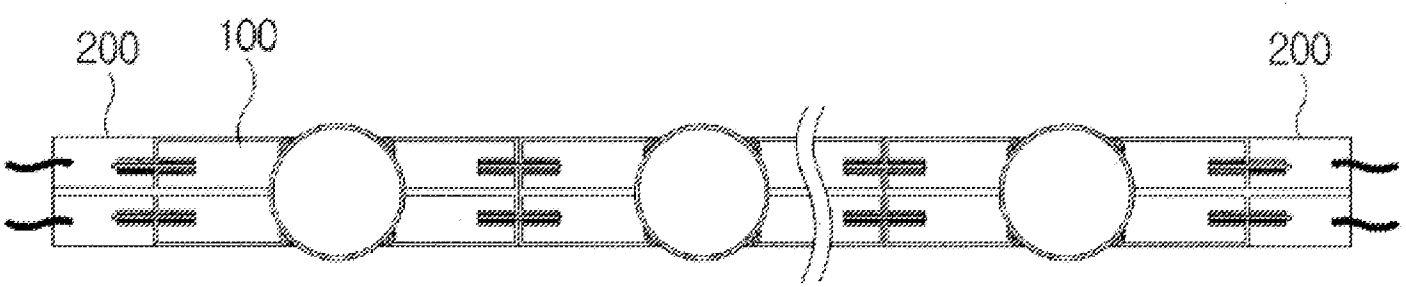
FIG. 4 is a view showing an installation state of the LED lighting devices according to an embodiment of the present invention.

FIG. 4 is a bottom view showing an installation state of the LED lighting devices according to an embodiment of the present invention.

Referring to FIG. 4, in the installation state according to an embodiment of the present invention, a plurality of unit modules 100 are disposed in a row when the indoor LED lighting device according to the embodiment of the present invention is one unit module 100, and the unit modules are connected to each other by the first to fourth connection bars 81 to 84 in the above-described example to receive electric power through the power supply units 200 provided at opposite ends of the set of the plurality of unit modules 100.

Electric power can be supplied to the substrates of all the unit modules 100 without installing a power supply unit in each of the unit modules 100 by coupling the bell-shaped reflection unit 50 including the substrate 70 to the socket 40 of each fixing bar 10 while the above-described fixing bar 10 is attached to a ceiling and coupling the first to fourth connection bars 81 to 84 to the first to fourth slit connection units 31 to 34 of the neighboring unit modules 100.

This structure can be easily installed and maintained as compared with the configuration according to the related art in which a power supply unit should be connected to each module.

Figure 5:
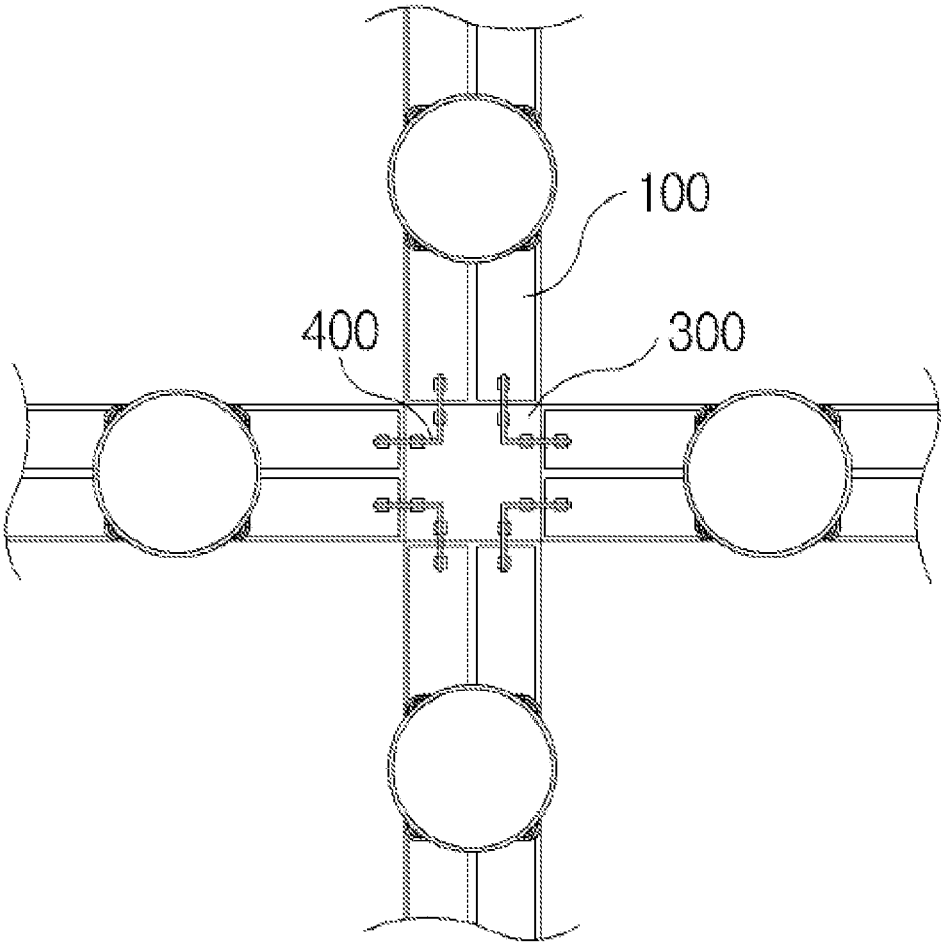
FIG. 5 is a view showing an installation state of the LED lighting devices according to another embodiment of the present invention.

FIG. 5 is a bottom view showing an installation state of the LED lighting devices according to another embodiment of the present invention.

An example of FIG. 5 describes that the indoor LED lighting devices according to the present invention may be expanded in various directions about one power supply unit 300 instead of being extended in one direction.

The power supply unit 300 is a square panel, and it can be seen that four connection bars bent by 90 degrees are used to easily supply electric power to the unit modules 100 extending while contacting four edges of the power supply unit 300.

In the example, the indoor LED lighting devices may be installed on an entire surface of the ceiling in the form of a mesh net and voltage drops generated in the unit modules 100 installed on the ceiling having a wide area are compensated for by using a plurality of power supply units 300.

Figure 6:
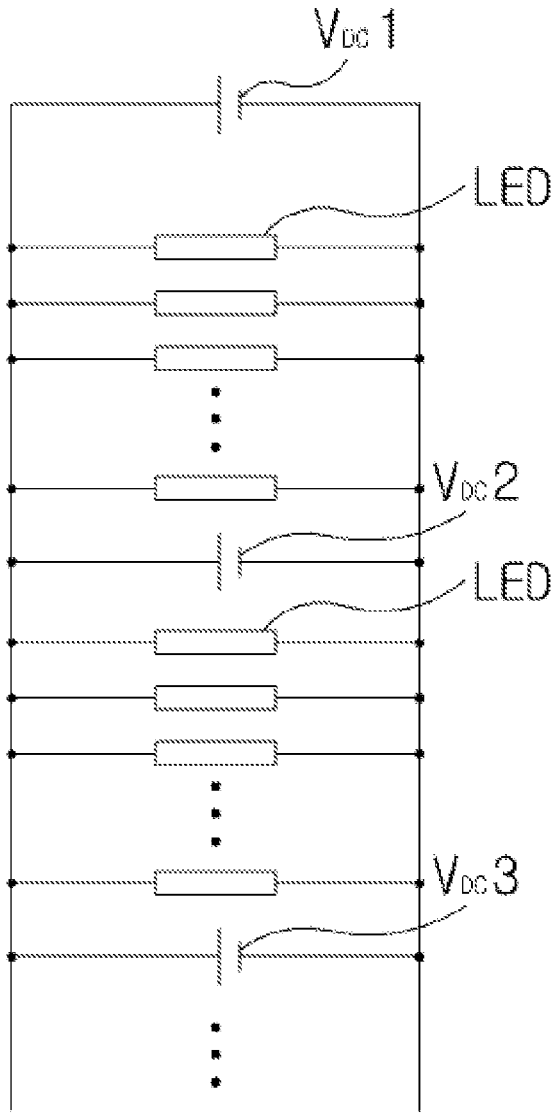
FIG. 6 is an equivalent circuit diagram of an installation state of the LED lighting devices according to the present invention.

FIG. 6 is an equivalent circuit diagram of an installation state of the easily expandable LED lighting devices according to the present invention.

Referring to FIG. 6, LEDs of a plurality of unit modules 100 are connected to each other in parallel, and the LEDs and a plurality of DC power sources VDC1 to VDC3 are connected to the LEDs in parallel such that a suitable voltage may be supplied to the LEDs of all the unit modules 100 without causing a voltage drop even when the LEDs are installed on the entire wide ceiling in the form of a net as in the example of FIG. 5.

The power supply units 200 and 300 function to distribute a DC current commonly provided on the ceiling of the interior to the unit modules 100 extending in one direction or various directions, and the structures below the socket 40 may be regarded as being eliminated from the unit module 100 and it may be understood that the shape of the unit modules 100 is determined according to a distribution direction of electric power.

It will be appreciated by those skilled in the art to which the present invention pertains that the present invention is not limited to the embodiment and may be variously modified without departing from the spirit of the present invention.

The present invention is industrially applicable because an operation of installing an indoor lighting device can be easily carried out by fixing a fixing bar to an interior, arranging electrodes in the fixing bars, and providing a plurality of LEDs, electric power of which is supplied by the electrodes.

The invention claimed is:

1. An easily expandable indoor LED lighting device comprising:

a fixing bar installed on a ceiling;

first and second electrode bars provided on a bottom surface of the fixing bar;

a socket provided at the center of the fixing bar provided with the first and second electrode bars; and a bell-shaped reflection unit coupled to the socket, for supplying electric power of the first and second electrode bars to a substrate to which an LED is mounted.

2. The easily expandable indoor LED lighting device of claim 1, wherein slit connection units connected to neighboring lighting devices through connection bars are provided at opposite ends of bottom surfaces of the first and second electrode bars.

3. The easily expandable indoor LED lighting device of claim 1, wherein the fixing bar is fixed to the ceiling of the interior by a double-sided tape or a bolt.

4. The easily expandable indoor LED lighting device of claim 1, wherein the first electrode bar and the second electrode bar are thin metal plates or a coating layer of a metal paste.

5. The easily expandable indoor LED lighting device of claim 1, wherein the bell-shaped reflection unit sets a light emission angle of the LED to 10 to 90 degrees.

6. The easily expandable indoor LED lighting device of claim 1, further comprising:

a power supply unit fixed to the ceiling while contacting the fixing bar and connecting a power source provided on the ceiling to the first and second electrode bars.

7. The easily expandable indoor LED lighting device of claim 6, wherein one power supply unit or two or more power supply units are connected to the LED in parallel.

* * * * *